US005546682A

United States Patent [19]

Skerry

[11] Patent Number: 5,546,682

[45] Date of Patent: Aug. 20, 1996

[54] SEDIMENT RELOCATION MACHINE

[76] Inventor: Eric Skerry, 370 North Market St., Summerside, Canada, C1N 1L8

[21] Appl. No.: 328,276

[22] Filed: Oct. 5, 1994

[51] Int. Cl.[6] ..... E02F 3/88

[52] U.S. Cl. ..... 37/322; 37/323; 37/355; 405/163

[58] Field of Search ..... 37/321, 322, 324, 37/323, 329, 327, 333, 335; 405/163, 164

[56] References Cited

U.S. PATENT DOCUMENTS

| | | | |
|---|---|---|---|
| 89,073 | 4/1869 | Quinn . | |
| 95,213 | 9/1869 | Elliott . | |
| 184,998 | 12/1876 | Tassey . | |
| 205,584 | 7/1878 | Smith . | |
| 260,200 | 6/1882 | Huffer . | |
| 284,387 | 9/1883 | Cornelius et al. . | |
| 285,487 | 9/1883 | Huffer . | |
| 294,303 | 2/1884 | Anderson . | |
| 296,483 | 4/1884 | Stone . | |
| 301,682 | 7/1884 | Coiseau . | |
| 306,206 | 10/1884 | Anderson . | |
| 418,000 | 12/1889 | Fletcher . | |
| 423,716 | 3/1890 | Baker . | |
| 445,862 | 2/1891 | Roessler . | |
| 449,479 | 3/1891 | Holden . | |
| 532,183 | 1/1895 | Pike | 37/329 X |
| 543,637 | 7/1895 | Bates | 37/323 |
| 616,675 | 12/1898 | Kretz . | |
| 1,268,387 | 6/1918 | Reed . | |
| 1,572,472 | 2/1926 | Doren . | |
| 1,701,430 | 2/1929 | Thurston | 37/329 X |
| 2,076,823 | 4/1937 | Newell | 37/323 X |
| 2,125,740 | 8/1938 | Schacht | 37/323 X |
| 2,262,943 | 11/1941 | Kalbaugh | 37/322 |
| 2,718,717 | 9/1955 | Collins | 37/322 |
| 2,952,083 | 9/1960 | Forkner | 37/323 X |
| 2,956,354 | 10/1960 | Varner | 37/323 |
| 3,019,535 | 2/1962 | Talbott et al. . | |
| 3,187,447 | 6/1965 | Hollyoak . | |
| 3,402,487 | 9/1968 | Vaughan et al. . | |
| 3,599,354 | 8/1971 | Larson . | |
| 3,926,003 | 12/1975 | Norman | 405/163 X |
| 4,123,858 | 11/1978 | Batchelder | 37/323 X |
| 4,479,741 | 10/1984 | Berti et al. | 405/163 |
| 4,604,000 | 8/1986 | Van Weezenbeek . | |
| 4,819,347 | 8/1989 | Lofgren . | |
| 4,943,186 | 7/1990 | Van Weezenbeek . | |
| 5,201,877 | 4/1993 | Relin et al. | 37/321 X |

FOREIGN PATENT DOCUMENTS

| | | |
|---|---|---|
| 446073 | 6/1948 | Italy . |

*Primary Examiner*—Terry Lee Melius
*Assistant Examiner*—Victor Batson
*Attorney, Agent, or Firm*—Robert A. Wilkes

[57] ABSTRACT

The invention relates to an apparatus for relocating sedimentary materials particularly from the bottom of water channels. The invention utilizes a water jet fluidizer to displace sedimentary materials and to suspend them in a water flow. The water flow containing the suspended, dispersed sedimentary material is contained within a shaped duct means and re-directed as a uni-directional flow, so that re-deposition of the displaced sediments is controlled. The apparatus includes a manifold having parallel water jets spaced apart in a transverse direction along it; a parallelogram linkage for controlling the position of the manifold; a hose for supplying water under pressure to the manifold; and a duct means arranged opposite the manifold for directing the flow of dislodged sedimentary material in suspension. The apparatus preferably is supported on wheels and is controlled by the linkage from a boat. In shallow water, the device may be supported on a hand controlled trolley. The apparatus provides the advantage that dislodged sedimentary material may be re-deposited with more control in a desired location.

18 Claims, 6 Drawing Sheets

SEDIMENT RELOCATION MACHINE

This invention is concerned with machines used to relocate relatively easily moveable materials which are found in sundry water channels. These materials generally are essentially sedimentary materials, which can be moved about by natural currents in the water to create sand bars and the like. These sedimentary materials often have to be removed or relocated for various reasons, typically to keep a water channel open for the use of boats and shipping. Similar techniques can also be used in harvesting various species which live in, or on, the seabed, such as clams.

One method commonly advocated for relocating sand bars and the like is to loosen the sediment by applying to it a jet of water. The pressure used, and the size of the jet, depends largely on the nature of the sediment being loosened, and on the amount of sediment it is desired to remove as a function of time. Sediment relocation machines of this general type are well known in the art, an early example being US 89,073, Quinn, issued in 1869. More recent examples are to be found in U.S. Pat. No. 4,604,000, Van Weezenbeek, which is concerned with moving liquified mud, in U.S. Pat. No. 4,819,347, Logfren and U.S. Pat. No. 4,943,186 Van Weezenbeek, both of which are concerned with improvements in the design of the water jets. Water jets have also been used to dislodge weed growth from the bottom of a water channel, as described in U.S. Pat. No. 3,599,354, Larson.

In order to move or relocate the loosened sedimentary material, the art appears to rely effectively entirely on the effects of the water flow present in the waterway. Quinn refers to utilising the current in a seaway to do this. Similarly, both Logfren and Van Weezenbeek (in U.S. Pat. No. 4,604,000) rely on existing water flows to transport away the loosened sediments. By controlling carefully the amount of water used, for example, Van Weezenbeek teaches that loosened mud can be made fluid enough to flow along the bottom of a channel to a lower point, largely under gravity, and not rise to the surface.

Even though many devices for relocating sediments, such as sand, mud, and the like, from the bed of waterways have been described, there still exists a real need for such a device, which will not just remove a hazard to navigation such as a sand bar, but will also control at least to a significant extent the locus to which the dislodged sedimentary material is relocated. If the flow pattern in the water is relied upon exclusively to relocate the removed sediments, then there is little, if any, control over where those sediments will be redeposited.

This invention seeks to provide a sediment relocation machine which overcomes these difficulties. It is based on the concept that sediment particles, such as those which make up sand and mud, will stay suspended in a rapid uni-directional flow of water, even though the particles are heavier than water, until either the uni-directional flow velocity decreases below a threshold value, or the flow ceases to be uni-directional, and becomes multi-directional or turbulent. In the sediment relocation device of this invention a water jet fluidizer is used to displace the sedimentary deposits, and to suspend them in a water flow. The water flow containing the suspended, dispersed sedimentary material is contained within shaped ducting and redirected as a uni-directional water flow in a horizontal and/or vertical direction, so that redeposition of the displaced sediments is controlled. The uni-directional flow of water containing the suspended displaced sedimentary materials then can be released to a chosen locus, for example along the side of a channel rather than simply into the channel flow, which, as noted above, will merely deposit it at some uncontrolled location further down stream. In a modification of the invention, the sediment relocation machine is used in conjunction with a propeller system which provides a substantially uni-directional wash, such as that described by Harrison, U.S. Pat. No. 5,145,428.

Thus in a first broad embodiment this invention seeks to provide an apparatus for relocating sedimentary material submerged under water comprising in combination:

- a plurality of water jets having substantially parallel outlets spaced apart in a transverse direction along a manifold means;
- means for maintaining the fluid jets in an effective position relative to the sedimentary material;
- means for pumping water under pressure into the manifold and through the jets in a flow direction generally perpendicular to the transverse direction, thereby dislodging the sedimentary material with water to produce a turbulent flow of water containing dislodged sedimentary material;
- duct means in cooperating relationship with the manifold means and the sedimentary material to receive the turbulent flow of water containing dislodged sedimentary material and to convert the turbulent flow into a uni-directional flow along the ducting; and
- exit means from the duct means through which the uni-directional flow containing dislodged sedimentary material is released in a desired direction.

The invention will now be described with reference to the drawings in which.

Figure 1:
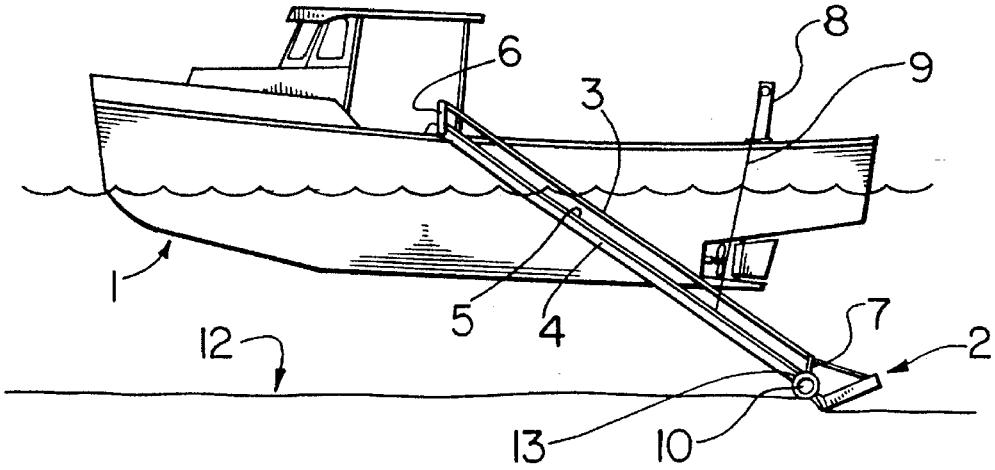
FIG. 1 shows the general arrangement of the sediment relocator attached to a typical inshore fishing boat.
Figure 2:
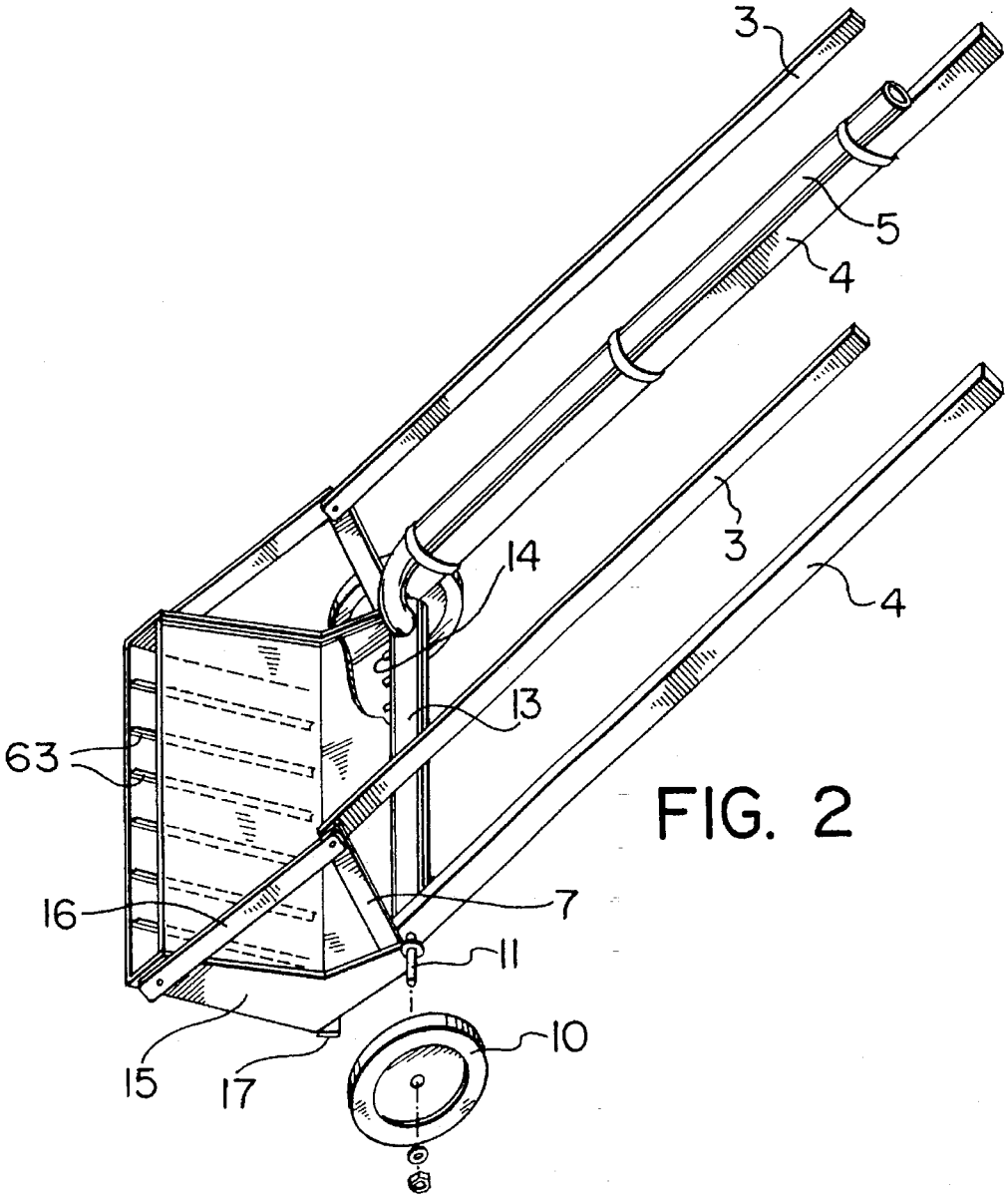
FIG. 2 shows in more detail the arrangement of the sediment relocator shown in FIG. 1 from which the second stage ducting is omitted.

Referring first to FIGS. 1 and 2, an embodiment of the sediment relocation machine adapted for use in relatively deep water is shown. The sediment relocation machine is shown attached to a typical inshore fishing boat 1. As is well known in this art, any other form of floating platform can also be used, such as a pontoon, barge, or the like. The platform will carry suitable ancillary equipment such as a pump to supply water under pressure, suitable hosing and hose connections, and means to lower the sediment relocation machine into, and to lift it from, the water such as a powered winch system. The platform may also include a motor powering a propeller to move it through the water, and suitable steering gear.

The sediment relocation machine shown generally at 2—the ducting is omitted for clarity—is attached to the boat 1 by a suitable means to lower it into and lift it out of the water. The machine is attached to the boat 1 by the pairs of upper angle control arms 3, and lower floating arms 4, which are attached together at their ends by the pairs of separation arms 6,7. The sediment relocator is lowered into and lifted out of the water by the winch 8, to which is attached suitable tackle shown schematically at 9. The sediment relocator rolls on the wheels 10, located on axles 11, and which are in contact with the bottom 12. The sets of arms 3,4,6 and 7 provide a parallelogram linkage the function of which is discussed below. The position of the arms 6 on the boat or other platform is controlled by any suitable locking means, such as stops, friction engagement, or the like. At their lower ends, the control arms 6 are pivotally mounted to the boat deck or the like by any suitable means. Devices of this nature are well known. The parallelogram linkage also maintains the relocator at the same attitude as it moves up and down with changes in water depth. Water under pressure is supplied to the sand relocator from the on-board pump typically through a hose shown at 5. If desired, the floating arms 4 can be made of tubing through which the water is fed.

Turning now in more detail to FIG. 2, the main parts of the sediment relocator comprise a water manifold 13, to one side of which is attached a plurality of substantially parallel water nozzles or jets 14, which are spaced apart in a transverse direction along the manifold 13. The arms 7 are fixed to the manifold 13 so that the included angle between the flow axis of the jets and the arm 7 is about 90°, although this angle is not critical. The four arms 3,4,6 and 7 which make up the parallelogram linkage are pivoted to each other, and the lower separation arm 7 is rigidly attached to the manifold 13. Hence, controlling the position of the control arms 6 on the boat controls the angle of the manifold 13 to the bottom. This angle can be changed during use of the machine to achieve the desired rate of sedimentary material dislodgement. The wheels 10 are shown having axles 11 substantially in line with the manifold 13. Although there is some flexibility in the precise location of the wheels 10, the position shown has the advantage that it minimises any change in position of the sediment relocator as it travels along the bottom 12. A duct shown generally at 15 is attached at its upper end to the manifold 13 by the separation arms 7 and the duct arms 16, and is attached directly at the ends of the side faces to the ends of the manifold 13 close to the wheel axles 11. Movement of the parallelogram linkage has no effect on the position of the duct 15 relative to the manifold 13 and the jets 14. The angle of the duct 15 to the manifold 13, and to the jets 14 is changed by altering the length of the duct arms 16, which conveniently can be provided with a row of location holes at the duct ends thereof. The duct 15 can be provided, if desired, with a dredge blade 17 to assist in sediment removal.

Figure 3:
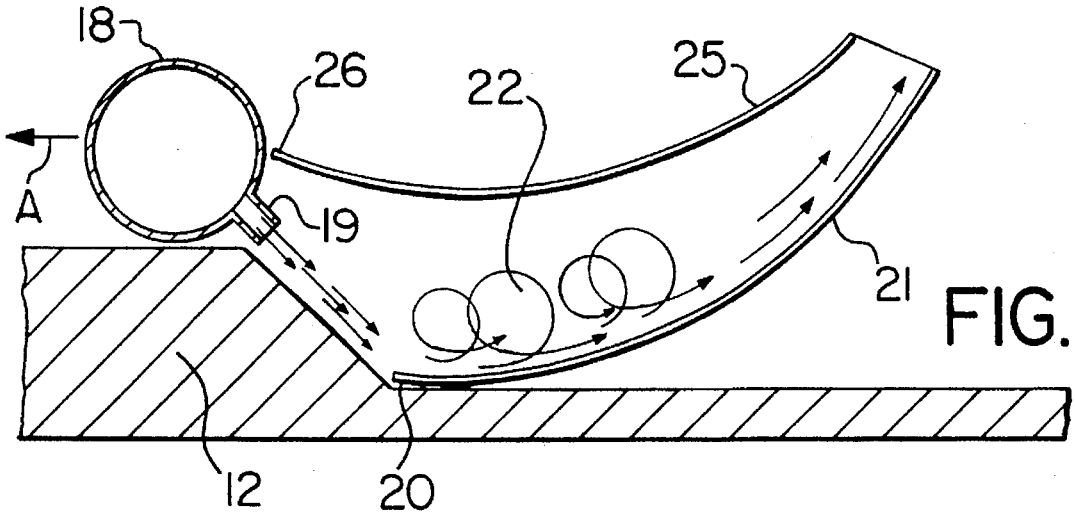
FIG. 3 shows in cross section an embodiment of the sediment relocator in which a curved duct is used.
Figure 4:
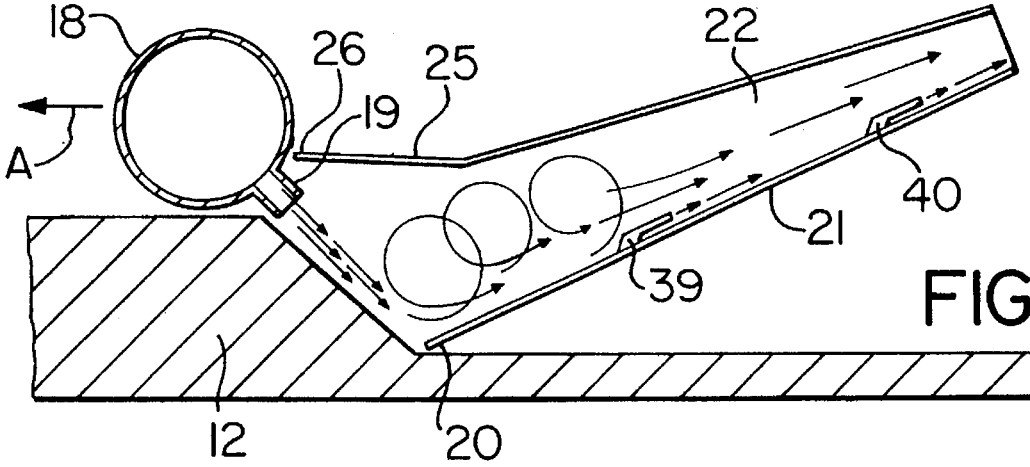
FIG. 4 shows in cross section an embodiment in which a straight duct is used.
Figure 8:
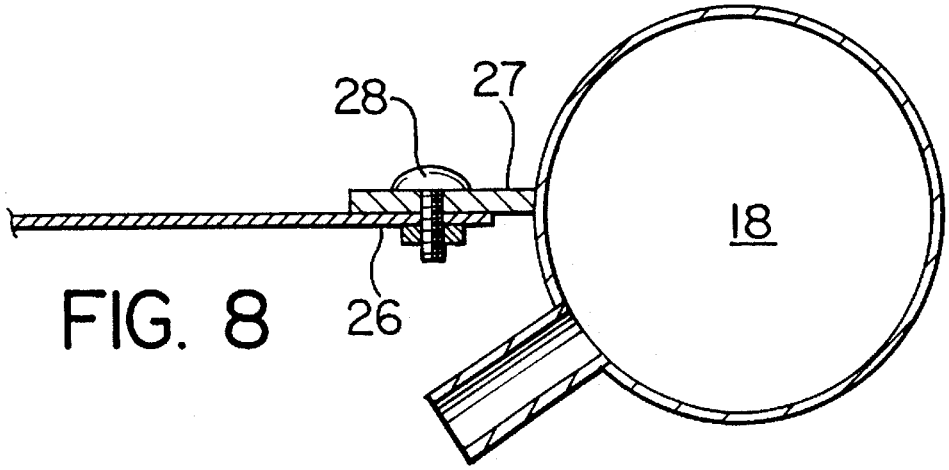
FIG. 8 shows a duct seal.

FIGS. 3, 4, 5 and 6 show in cross section the construction of the manifold 13, and how the sediment relocator operates. In each case, the sediment relocator is being moved in the direction of the arrow A. In FIG. 3 it can be seen that the relocator includes a fluidizer manifold 18 to which a row of water jets 19 is attached. Water under pressure from the hose 5 is fed to the manifold 18 and is directed as a pressurised stream toward the sediment on the bottom by the jets 19. In FIGS. 3, and 4 the jets 19 are aimed at the sediment a little ahead of the forward facing lip 20 of the lower face 21 of the duct 22. As is noted above, this lip can be provided with a dredge blade to assist in loosening sediments. In the configuration shown in FIG. 5 the jets are also aimed more or less at the trailing lip 24 of the trailing face 23 of the duct 22. In the configurations shown in each of FIGS. 3,4,5 and 6 some adjustment may be needed to obtain optimum jet angles. The angle of the jets can be changed during use by use of the parallelogram linkage 7. The top face 25 of the duct 22 extends to a point 26 closely adjacent to the manifold 18. In a similar fashion, a minimum gap is left between the ends of the side faces of the duct 22 and the manifold 18. As is shown in FIG. 8 it is advantageous to use a flexible seal 27, typically attached by nuts and bolts 28 to the end 26 of the duct 22, between the manifold 18 and the duct.

Figure 5:
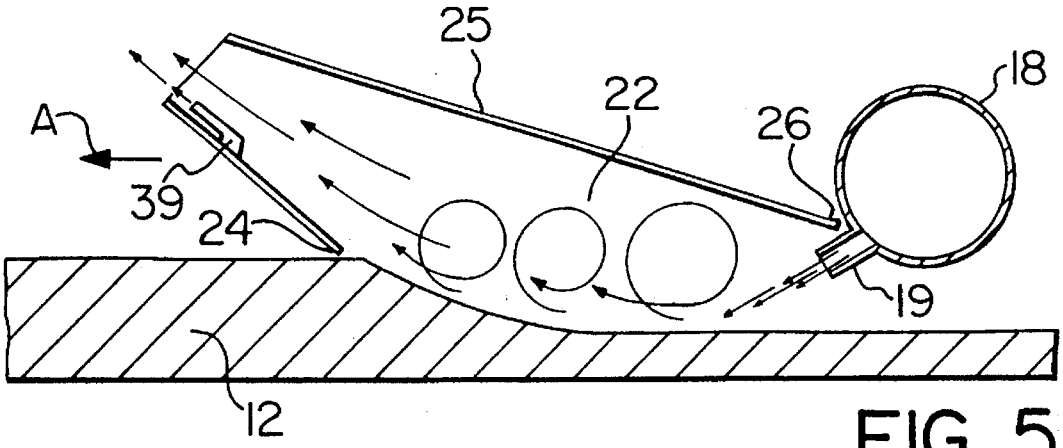
FIG. 5 shows in cross section an embodiment in which the duct is ahead of the water jets.
Figure 6:
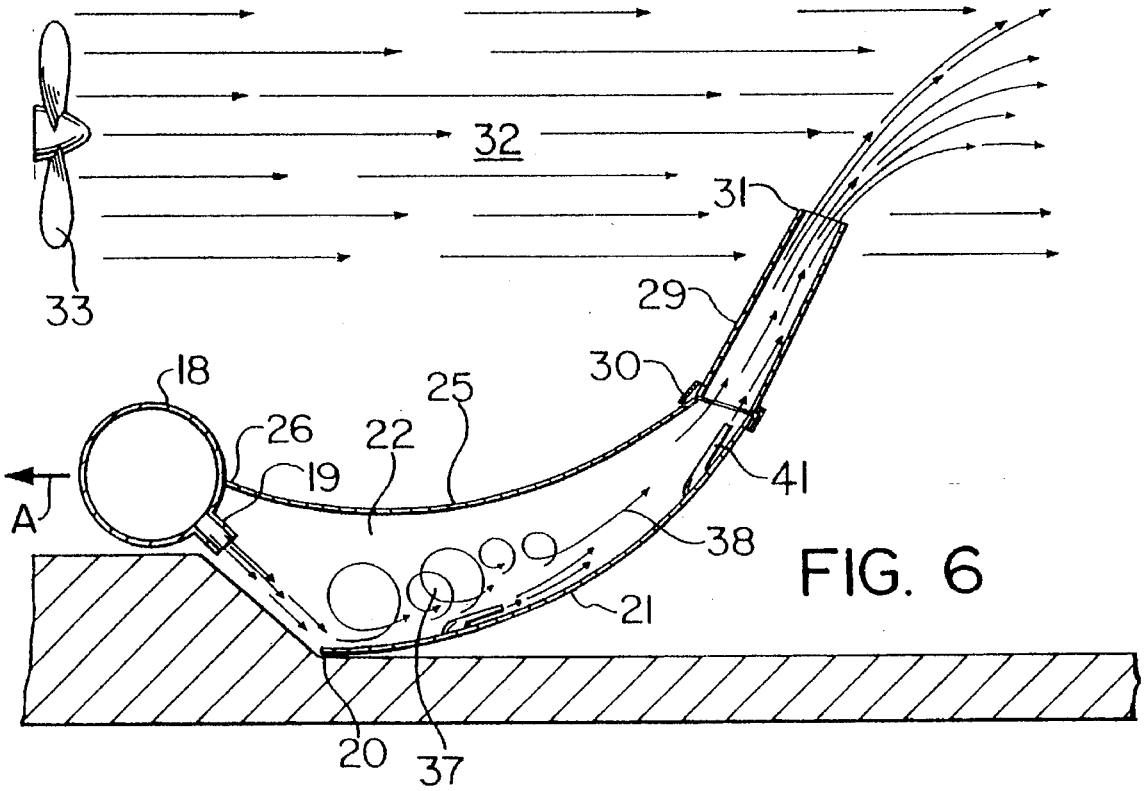
FIG. 6 shows an embodiment in which the sediments are discharged into a propeller wash.

FIG. 6 shows two further features of the invention. The manifold 18 and the duct 22 are as in FIGS. 3,4 and 5. In FIG. 6 the duct 22 is upwardly curved, and a second length of ducting 29 is attached to it by a suitable joint 30. The second duct ends at a point which is chosen to be in the wash 32 generated by the propeller 33. Although this wash is somewhat turbulent, it is moving faster than the surrounding water and will serve to transport the fluidised sediments further away. As noted above, this feature of the invention can be enhanced by using a ducted or shrouded propeller.

Figure 7:
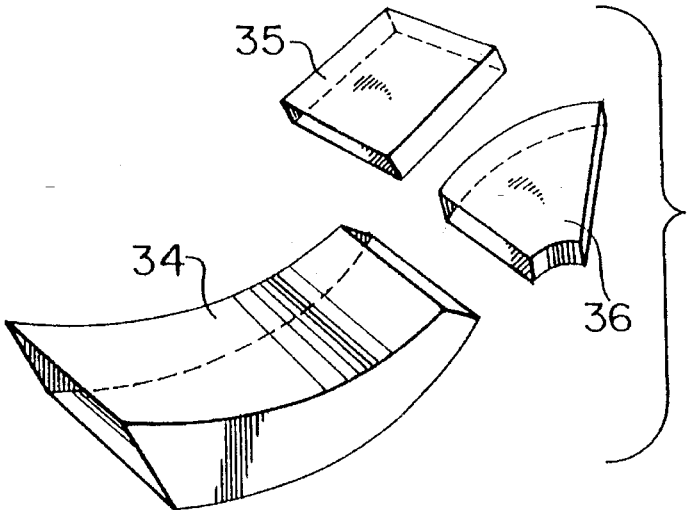
FIG. 7 shows some typical ducting sections.

In FIG. 7 are shown several possible useful duct parts, including a curved section 34, a straight section 35 and a corner section, 36. Duct sections of this type are used to direct the water borne sedimentary materials to a chosen location.

In use, water is supplied under suitable pressure from the hose 5 to the manifold 18, and directed from a plurality of jets 19 against the sediments 12 on the bottom. The water jets 19 then fluidise the sediments in a zone of turbulent water, as at 37 in FIG. 6. A dredge blade 17 attached to the edge 20 of the duct 22 can also be used to assist in dislodging sedimentary material. The turbulent water containing the displaced sediments is contained within the duct 22. Since there are minimal gaps, or a flexible seal 27, between the duct 22 and the manifold 18, the turbulent water flows along the duct 22, carrying the displaced sedimentary material with it, and soon becomes an essentially uni-directional flow, as at 38 in FIG. 6. The displaced sediments will stay in suspension in the uni-directional flow for the length of the ducting. The flow within the duct can be enhanced by incorporating additional duct jets into the sides of the ducting, as at 39, 40, and 41 (see FIGS. 4,5, and 6). These duct jets function to admit extra water to the uni-directional flow to keep the dislodged sedimentary material in suspension. Similar jets if desired can also be included in the duct sections of FIG. 7.

Figure 9:
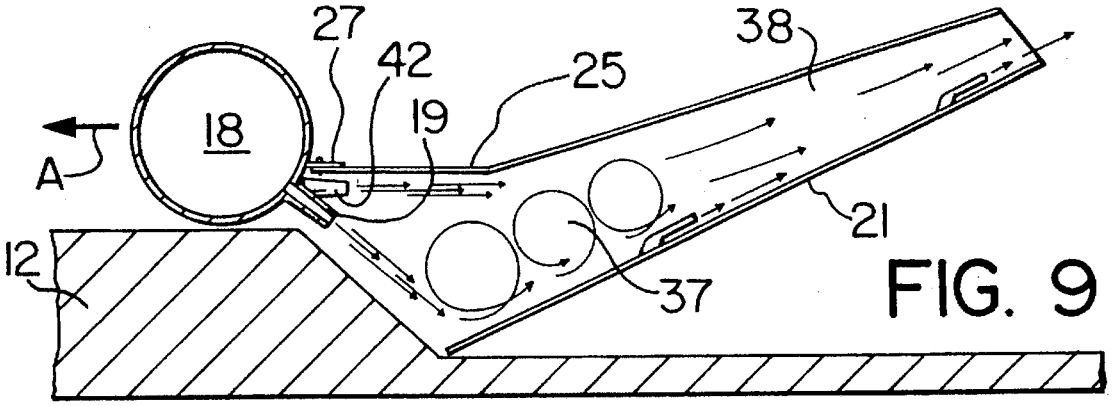
FIGS. 9 and 10 show modified manifolds.
Figure 10:
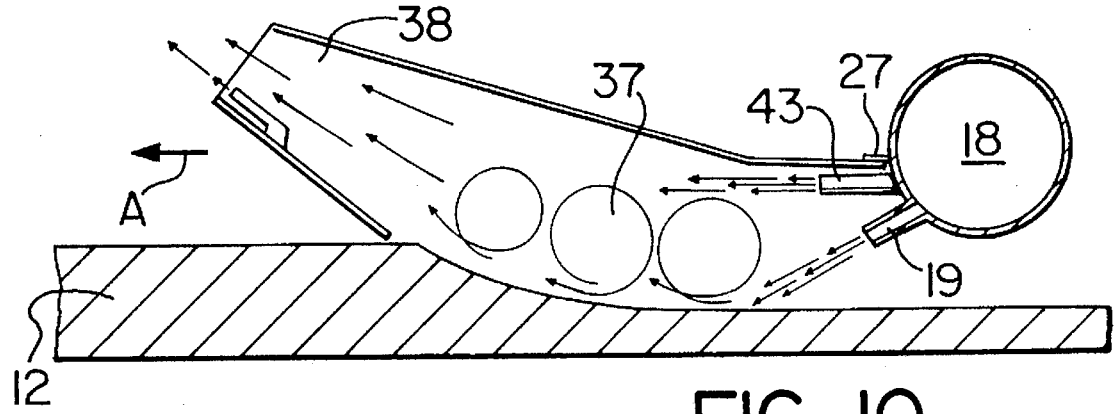

At the point where the sedimentary material is loosened from the bottom, rather than allowing the initially turbulent water flow containing these solids to lose its integrity, the ducting envelopes the water flow to maintain its integrity, and to convert it into a uni-directional flow. The sides of the duct 22 are substantially parallel to the water jets 19. It is also desirable to minimize the distance between the end 20 of the duct 22 and the jets 19. To facilitate sediment removal, the jets 19 will usually be pointed more or less toward the end edge 20 of the duct 22. The additional introduction of water through the duct jets such as 39 and 40 serves both to keep the sediments in suspension in the water, and to press the sediment relocator toward the sediments 11 on the bottom. In ducts having the shapes shown in FIGS. 3 and 6 the extra water creates a somewhat centrifugal flow exerting a downward force against the lower face 21 of the duct 22. In FIG. 4 as the lower face 21 is flat, the forces urging the duct 22 downward are lessened. In FIG. 5, as the relative positions of the manifold 18 and the duct 22 are reversed, although the intrusion of extra jetted water will help, the uni-directional flow will be of relatively low velocity. To increase the velocity, as is shown in FIGS. 9 and 10 either at least some of the jets 19 can be angled to point only a little below horizontal as at 42, or a second row of jets as at 43 can be provided. In either case the flow directly into the duct 22 is increased. The amount of water used for this purpose is controlled by both the size and number of the available jets that are used. Whilst use of these extra jets does limit the amount of sedimentary material which can be removed, it has the advantages of providing a much gentler action, and is effective where buried obstacles are present.

Figure 11:
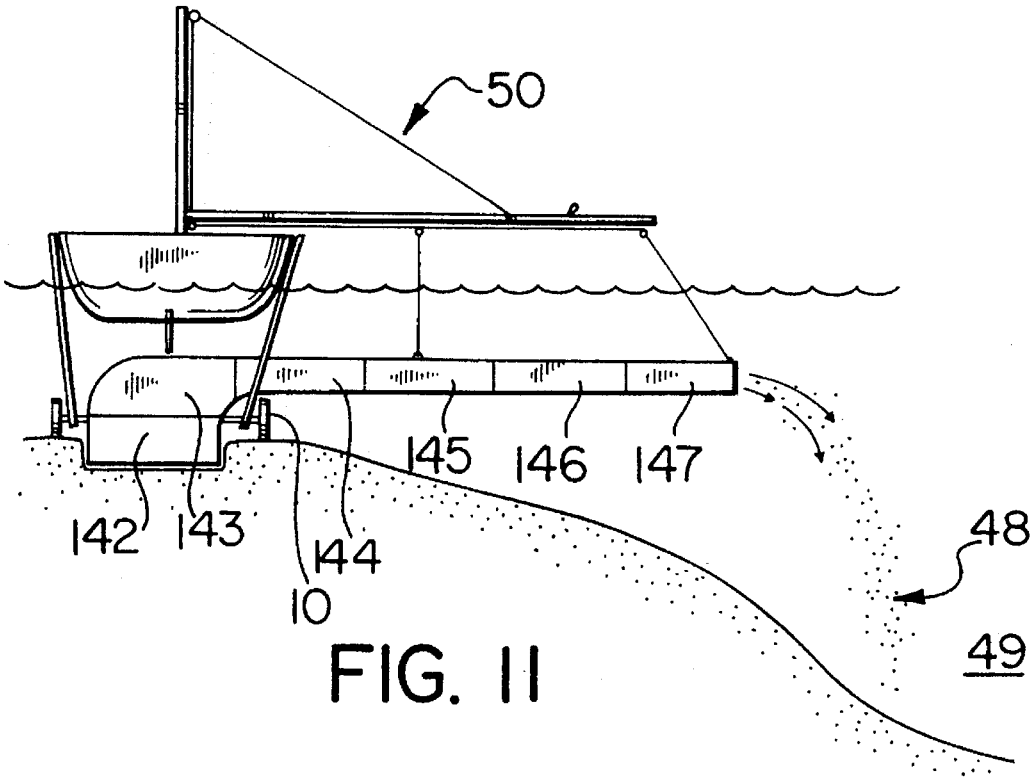
FIG. 11 shows an elongate duct system.

As the water flow containing the displaced sedimentary material moves along the duct 22, the duct cross section decreases gradually so as to maintain the uni-directional nature of the flow, and to maintain flow velocity. As is shown in FIG. 11, this permits the use of ducting which will allow both lateral redirection, and a limited amount of vertical lift in the ducting. In this instance, a long duct made up of six sections 142 through 147 is used to move bottom sediments 12 from the side of a channel and deposit them as at 48 into a stronger current in deep water as at 49. The elongate ducting is supported using a conventional winch and boom arrangement, as at 50. Where ducting of some length is used, it is advantageous to use a manifold 18 with two rows of jets, as in FIGS. 9 and 10, in order to provide sufficient water flow to keep the sedimentary materials in suspension in the uni-directional flow along the duct. The introduction of extra jetted water into the ducts through jets such as at 39, and 40 also assists in moving the water flow in a long duct.

More rapid attainment of the desired uni-directional flow can be assisted by the provision of upstanding flow plates 63 in FIG. 2 within the duct 22. These flow plates 63 project into the water flow from the duct upper or lower face, and are located near to the region of turbulence caused by the jets, and close to the edge 20 of the bottom plate 21.

Figure 12:
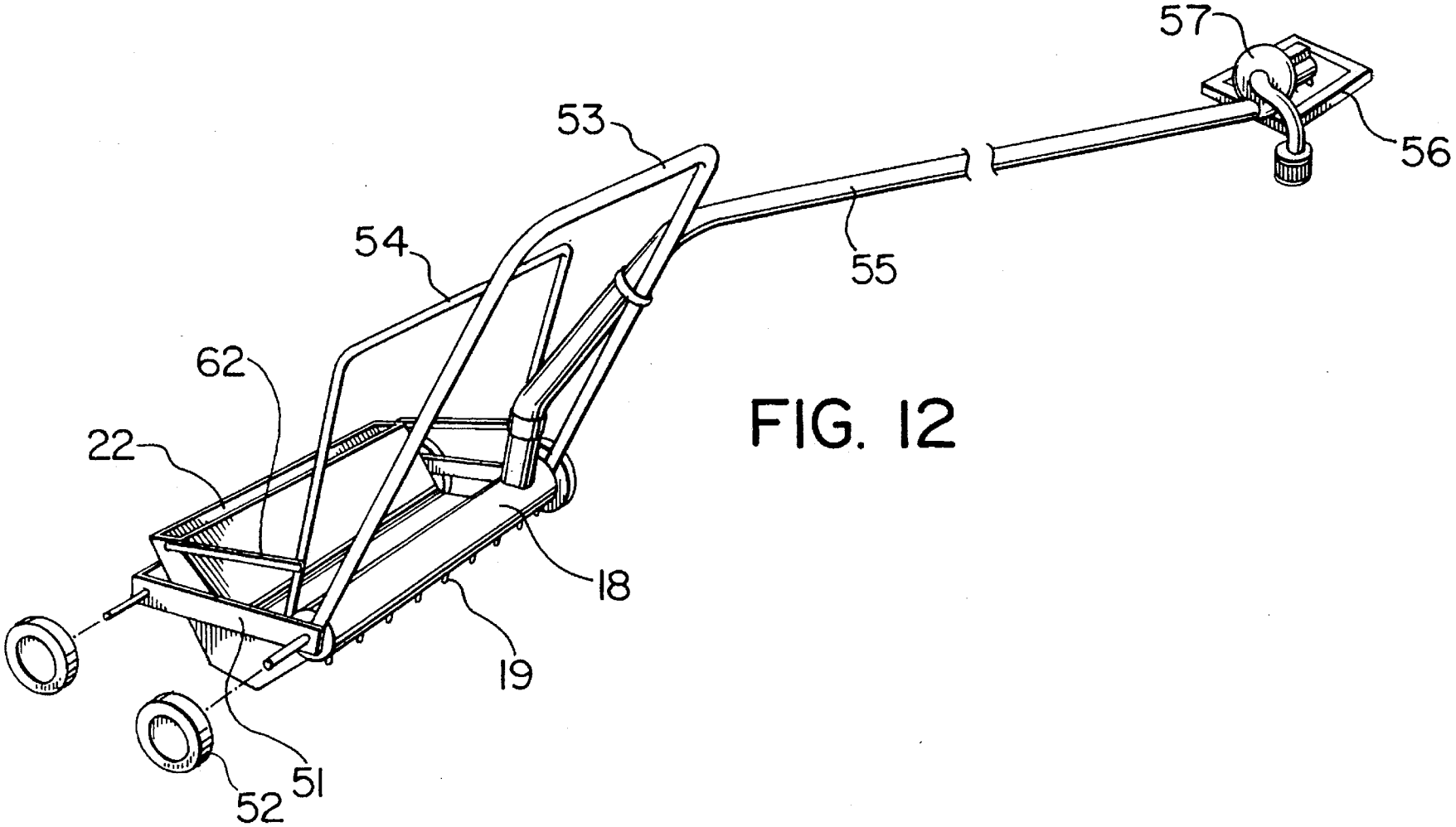
FIG. 12 shows a relocater for hand propulsion in shallow water.

The preceding description has been concerned with the use of the sediment relocation machine in relatively deep water, which will often be tidal water. The smaller embodiment of the sediment relocation machine can also be used in shallow water, and a typical embodiment is shown in FIG. 12. The principles of operation are much the same, as jetted water is used to dislodge the sedimentary materials into a uni-directional water flow within a duct. The main parts of the machine, including the manifold 18, the jets 19, and the duct 22 are mounted on a small trolley 51 provided with typically four wheels 52, although one front wheel will suffice. The machine is moved around by a person pushing against the push bar 53, which is pivoted into the trolley 51. Rotation of the push bar 53 about the pivots on the trolley controls the direction of the jets relative to the sedimentary material which is to be dislodged. The attitude of the duct 22 relative to the jets 19 is controlled by the position of the angle bar 54, which is attached to the duct 22 by the duct arms 62. Suitable stops, or a friction engagement, are used to retain both the push bar 53 and the angle bar 54, and hence both the water jets 19 and the duct 22, in a desired position. Water under suitable pressure is fed through the hose 55 from a pump means 57 shown supported by a floating platform, such as a raft 56. The pump 57 alternatively can be on the shore, on a dock or jetty, or in a small boat.

Figure 13:
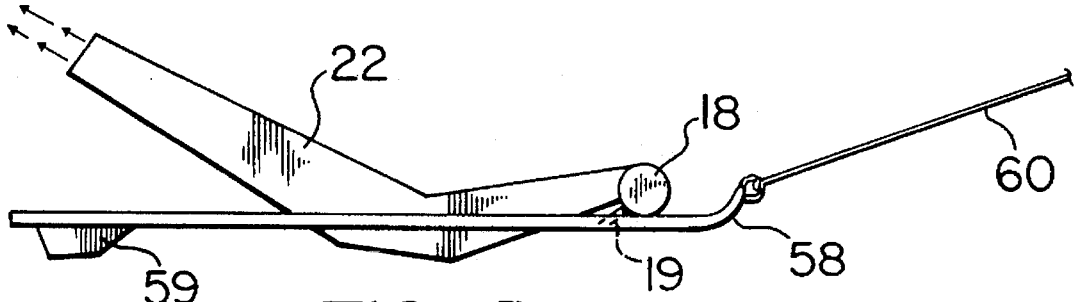
FIG. 13 shows an alternative construction using a sled.
Figure 14:
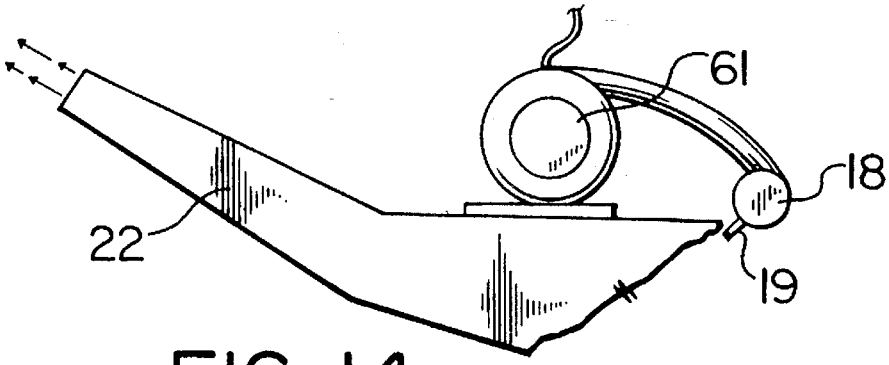
FIG. 14 shows a construction using a submersible pump.

Further alternative constructions are shown in FIGS. 13 and 14. The relocator still includes a manifold 18, jets 19, duct 22 and is fed with water under pressure. In FIG. 13, which is of use on a relatively flat bottom, the relocator is mounted onto a simple sled 58, which if desired has an adjustable runner 59. The sled is moved across the bottom by means of the towing hitch 60 attached to any suitable towing unit such as a boat or an onshore truck. In FIG. 14 rather than use a remote supply of water under pressure, a submersible pump 61 is mounted directly onto the frame of the sediment relocator.

I claim:

1. An apparatus for relocating sedimentary material adapted to be attached to a floating platform, which platform carries a pump means for supplying water under pressure, and a winch means to lower the sediment relocation machine into and to lift it from the water, comprising in combination:

manifold means having attached thereto at least one row of water jets having substantially parallel outlets spaced apart along the manifold means;

hose connection means constructed and arranged to supply water under pressure from the pump means to the manifold means and through the water jets in a flow direction generally perpendicular to the manifold means, thereby dislodging the sedimentary material with water to produce a turbulent flow of water containing dislodged sedimentary material;

pair of parallelogram linkages each comprising in combination:

a separation arm fixed to each end of the manifold means;

an upper angle control arm and a lower floating arm each pivotally attached to the ends of the separation arm; and a control arm pivotally attached to the ends of the upper angle control arm and the lower floating arm;

pivot means attaching the parallelogram linkage to the platform, including locking means to lock the control arm in a desired position;

support means attached to the manifold means adapted to support the manifold means on the sedimentary material;

duct means, in cooperating relationship with the manifold means, the duct means having upper, side, and lower faces, the ends of the side faces being attached to the manifold means so that the upper face is above the water jets, the side faces are adjacent each end of the manifold means, and each of the upper and side faces extend to be closely adjacent the manifold means to leave a minimum gap therebetween, to receive the turbulent flow of water containing dislodged sedimentary material and to convert the turbulent flow into a uni-directional flow substantially along the duct means;

duct arm means attached to the side face of the duct means, and to the upper end of the lower separation arm, whereby movement of the parallelogram linkage does not affect the position of the duct means relative to the manifold means, and exit means from the duct means through which the uni-directional flow containing dislodged sedimentary material is released in a desired direction.

2. An apparatus according to claim 1 wherein the water jets comprise at least a single row of water jets spaced apart along the manifold means.

3. An apparatus according to claim 1 wherein the water jets comprise a first and a second row of water jets, each row of water jets being spaced apart along the manifold means.

4. An apparatus according to claim 3 wherein the first row of water jets provides the turbulent flow of water containing dislodged sedimentary material, and the second row of water jets provides a flow of water augmenting the uni-directional flow substantially along the duct means.

5. An apparatus according to claim 1 further including in the duct means at least one water jet constructed and arranged to enhance the uni-directional flow within the duct means.

6. An apparatus according to claim 1 wherein the duct means includes at least one duct section.

7. An apparatus according to claim 1 further including flexible seal means between the ends of the upper and side faces of the duct means and the manifold means.

8. An apparatus according to claim 1 wherein the support means is chosen from the group consisting of:

wheels carried by axles attached to each end of the manifold means;

a sled; and a sled including at least one adjustable runner.

9. An apparatus according to claim 1 wherein the lower floating arm comprises a tube and incorporates the hose means.

10. An apparatus according to claim 1 wherein the duct means further includes a dredge blade constructed and arranged to loosen the sedimentary material.

11. An apparatus for relocating sedimentary material adapted to be hand controlled, comprising in combination:

manifold means having attached thereto at least one row of water jets having substantially parallel outlets spaced apart along the manifold means;

pump means constructed and arranged to supply water under pressure to the manifold means and through the water jets in a flow direction generally perpendicular to the manifold means, thereby dislodging the sedimentary material with water to produce a turbulent flow of water containing dislodged sedimentary material;

push bar means adapted to allow a user both to move the apparatus and to control the direction of the water jets relative to the sedimentary material to be dislodged;

duct means, having upper, side, and lower faces, the ends of the side faces being attached to the manifold means so that the upper face is above the water jets, the side faces are adjacent each end of the manifold means, and each of the upper and side faces extend to be closely adjacent the manifold means to leave a minimum gap therebetween, to receive the turbulent flow of water containing dislodged sedimentary material and to convert the turbulent flow into a uni-directional flow substantially along the duct means;

duct arm means pivotally attached to the side face of the duct means, and to an angle bar means, whereby the angle of the duct means relative to the water jets can be controlled by a user;

exit means from the duct means through which the uni-directional flow containing dislodged sedimentary material is released in a desired direction; and support means attached to the manifold means and to the duct means adapted to support both the manifold means and the duct means on the sedimentary material.

12. An apparatus according to claim 11 wherein the support means is chosen from the group consisting of:

a trolley, provided with wheels;

wheels carried by axles attached to each end of the manifold means;

a sled; and a sled including at least one adjustable runner.

13. An apparatus according to claim 12 wherein the support means comprises a trolley, provided with wheels.

14. An apparatus according to claim 11 wherein the water jets comprise at least a single row of water jets spaced apart along the manifold means.

15. An apparatus according to claim 11 wherein the water jets comprise at least a single row of water jets spaced apart along the manifold means together with at least one water jet, in the duct means constructed and arranged to enhance the uni-directional flow within the duct means.

16. An apparatus according to claim 11 wherein the duct means includes at least one duct section.

17. An apparatus according to claim 11 further including flexible seal means between the ends of the upper and side faces of the duct means and the manifold means.

18. An apparatus according to claim 11 wherein the duct means further includes a dredge blade constructed and arranged to loosen the sedimentary material.

* * * * *